US009169640B2

(12) United States Patent
Jeffers et al.

(10) Patent No.: US 9,169,640 B2
(45) Date of Patent: Oct. 27, 2015

(54) FRAMELESS GLASS MOUNTING SYSTEM

(71) Applicant: Steelcase Inc., Grand Rapids, MI (US)

(72) Inventors: Robert E. Jeffers, Ada, MI (US); Roy Fink, Portgage, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 13/912,749

(22) Filed: Jun. 7, 2013

(65) Prior Publication Data

US 2013/0326976 A1 Dec. 12, 2013

Related U.S. Application Data

(60) Provisional application No. 61/657,387, filed on Jun. 8, 2012.

(51) Int. Cl.
*E04B 2/74* (2006.01)
*A47B 83/00* (2006.01)

(52) U.S. Cl.
CPC ..... *E04B 2/7416* (2013.01); *E04B 2/7422* (2013.01); *E04B 2/7424* (2013.01); *A47B 83/001* (2013.01); *A47B 2220/0077* (2013.01); *E04B 2002/7418* (2013.01); *E04B 2002/7461* (2013.01); *E04B 2002/7483* (2013.01)

(58) Field of Classification Search
CPC ..... E04B 2/7416; E04B 2/7424; E04B 2002/7418; E04B 2002/7461; E04F 11/1851; E04F 11/1853; A63B 71/022; A63C 19/10; A63C 2019/085
USPC ..... 52/126.1, 126.3, 126.4, 238.1, 239, 52/36.1, 204.67, 204.71; 256/24, 25; 472/92, 94
See application file for complete search history.

(56) References Cited

U.S. PATENT DOCUMENTS

| | | | | | |
|---|---|---|---|---|---|
| 2,915,151 | A | * | 12/1959 | Kekenak | 52/781 |
| 3,288,157 | A | * | 11/1966 | Szkolny | 135/95 |
| 3,370,389 | A | * | 2/1968 | Macaluso | 52/239 |
| 3,371,454 | A | * | 3/1968 | Anderson | 52/126.4 |
| 3,553,916 | A | * | 1/1971 | Lickliter | 52/281 |
| 3,745,732 | A | * | 7/1973 | Pritchard et al. | 52/239 |
| 3,844,539 | A | * | 10/1974 | Abbott | 256/24 |
| 4,054,268 | A | * | 10/1977 | Sher | 256/24 |
| 4,103,874 | A | * | 8/1978 | Horgan, Jr. | 256/24 |
| 4,423,582 | A | * | 1/1984 | Yates | 52/800.16 |
| 4,671,016 | A | * | 6/1987 | Boeckx | 49/501 |
| 4,680,903 | A | * | 7/1987 | Horgan, Jr. | 52/127.8 |
| 4,763,453 | A | * | 8/1988 | Horgan, Jr. | 52/127.8 |
| 4,819,781 | A | * | 4/1989 | Saito et al. | 198/335 |
| 4,914,888 | A | * | 4/1990 | Hanson | 52/768 |
| 4,920,717 | A | * | 5/1990 | Hooper, Jr. | 52/204.597 |

(Continued)

OTHER PUBLICATIONS

Steelcase Inc., "Answer Frameless Glass Assembly Instructions," published in U.S.A. in 2010, 9 pages.

*Primary Examiner* — Robert Canfield
(74) *Attorney, Agent, or Firm* — Price Heneveld LLP

(57) ABSTRACT

A frameless mounting system for glass or the like includes one or more bracket assemblies that adjustably interconnect a sheet of material along an upper edge of an existing partition system. The bracket assemblies permit the sheet of material to be adjusted upwardly or sidewardly to align the sheets of material with adjacent sheets of material. Furthermore, the sheets of material can be tilted as required to align adjacent sheets. The sheet of material is preferably transparent glass, but may comprise various other materials such as polymers, translucent materials, frosted, or opaque materials.

21 Claims, 6 Drawing Sheets

(56) References Cited

U.S. PATENT DOCUMENTS

| | | | | |
|---|---|---|---|---|
| 5,069,010 | A * | 12/1991 | Trainor et al. | 52/127.8 |
| 5,706,625 | A * | 1/1998 | Vallance et al. | 52/766 |
| 5,899,035 | A | 5/1999 | Waalkes et al. | |
| 5,953,882 | A * | 9/1999 | Vallance et al. | 52/766 |
| 6,009,675 | A | 1/2000 | Waalkes et al. | |
| 6,079,173 | A | 6/2000 | Waalkes et al. | |
| 6,098,358 | A | 8/2000 | Waalkes et al. | |
| 6,178,702 | B1 | 1/2001 | Hand et al. | |
| 6,276,103 | B1 | 8/2001 | Waalkes et al. | |
| 6,301,846 | B1 | 10/2001 | Waalkes et al. | |
| 6,442,909 | B2 | 9/2002 | Waalkes et al. | |
| 6,517,056 | B2 * | 2/2003 | Shepherd | 256/24 |
| 6,546,684 | B2 | 4/2003 | Waalkes et al. | |
| 6,783,461 | B2 * | 8/2004 | Frazier et al. | 472/92 |
| 6,910,306 | B2 | 6/2005 | Waalkes et al. | |
| 6,912,818 | B2 * | 7/2005 | Sprague | 52/208 |
| 7,036,799 | B2 * | 5/2006 | Shepherd | 256/73 |
| 7,448,168 | B2 | 11/2008 | Waalkes et al. | |
| 7,559,536 | B1 * | 7/2009 | Hansen et al. | 256/25 |
| 7,565,772 | B2 | 7/2009 | Waalkes et al. | |
| 7,584,588 | B2 * | 9/2009 | Kim | 52/800.14 |
| 7,866,636 | B1 * | 1/2011 | Hansen | 256/65.14 |
| 7,914,385 | B2 * | 3/2011 | Palumbo et al. | 472/92 |
| 7,963,077 | B2 * | 6/2011 | Lin | 52/204.597 |
| 8,181,405 | B2 * | 5/2012 | Nash | 52/238.1 |
| 8,500,110 | B2 * | 8/2013 | Allen | 269/297 |
| 8,826,621 | B2 * | 9/2014 | Noble | 52/584.1 |
| 2007/0287548 | A1 * | 12/2007 | Irving et al. | 472/90 |
| 2009/0031653 | A1 * | 2/2009 | Nash | 52/238.1 |
| 2009/0230372 | A1 * | 9/2009 | Sprague | 256/24 |
| 2010/0225040 | A1 * | 9/2010 | Allen | 269/297 |
| 2010/0242378 | A1 * | 9/2010 | Cifelli | 52/126.1 |

* cited by examiner

FRAMELESS GLASS MOUNTING SYSTEM

CLAIM OF PRIORITY

This application claims the benefit of U.S. Provisional Application No. 61/657,387 filed on Jun. 8, 2012 entitled, FRAMELESS GLASS MOUNTING SYSTEM, the entire contents of which are incorporated herein by reference.

BACKGROUND OF THE INVENTION

Various types of partition systems have been developed for offices and other such areas. Examples of partition systems can be found in, for example, U.S. Pat. Nos. 6,910,306, 6,009,675, 6,079,173, 6,098,358, 6,276,103, 6,301,846, 6,442,909, 5,899,035, the contents of each of which are hereby incorporated by reference. Partition systems of this type have a knock-down ("KD") construction, whereby posts and beams are assembled on site at the time the partition is installed. Other known commercially available partition systems generally utilize a plurality of rigid rectangular frames that have a general construction similar to a picture frame.

BRIEF SUMMARY OF THE INVENTION

One aspect of the present invention is a free standing post and beam partition system that has a rigid frame that includes two or more upright posts, each defining opposite side faces. The system also includes upper and lower beams with opposite ends thereof connected to side faces of the posts. The improvement to the partition system includes an upright sheet that may comprise an opaque material or light transmitting material. The sheet defines generally planar vertical opposite side faces and horizontally extending upper and lower edges, and vertically extending opposite side edges that together form a generally quadrilateral perimeter. The improvement also includes at least one bracket positioned above the upper beam. The bracket has an upwardly opening channel that receives at least a portion of the lower edge of the sheet of light transmitting material. The bracket includes movable clamp members engaging the opposite side faces of the sheet of light transmitting material and adjustably securing the sheet of material in a manner that permits the sheet of light transmitting material to be tilted to a user-determined angle whereby the sheet can be adjusted and aligned with sheets of light transmitting material of adjacent panels.

These and other features, advantages, and objects of the present invention will be further understood and appreciated by those skilled in the art by reference to the following specification, claims, and appended drawings.

BRIEF DESCRIPTION OF THE DRAWINGS

FIG. 3;

DETAILED DESCRIPTION

Figure 1:
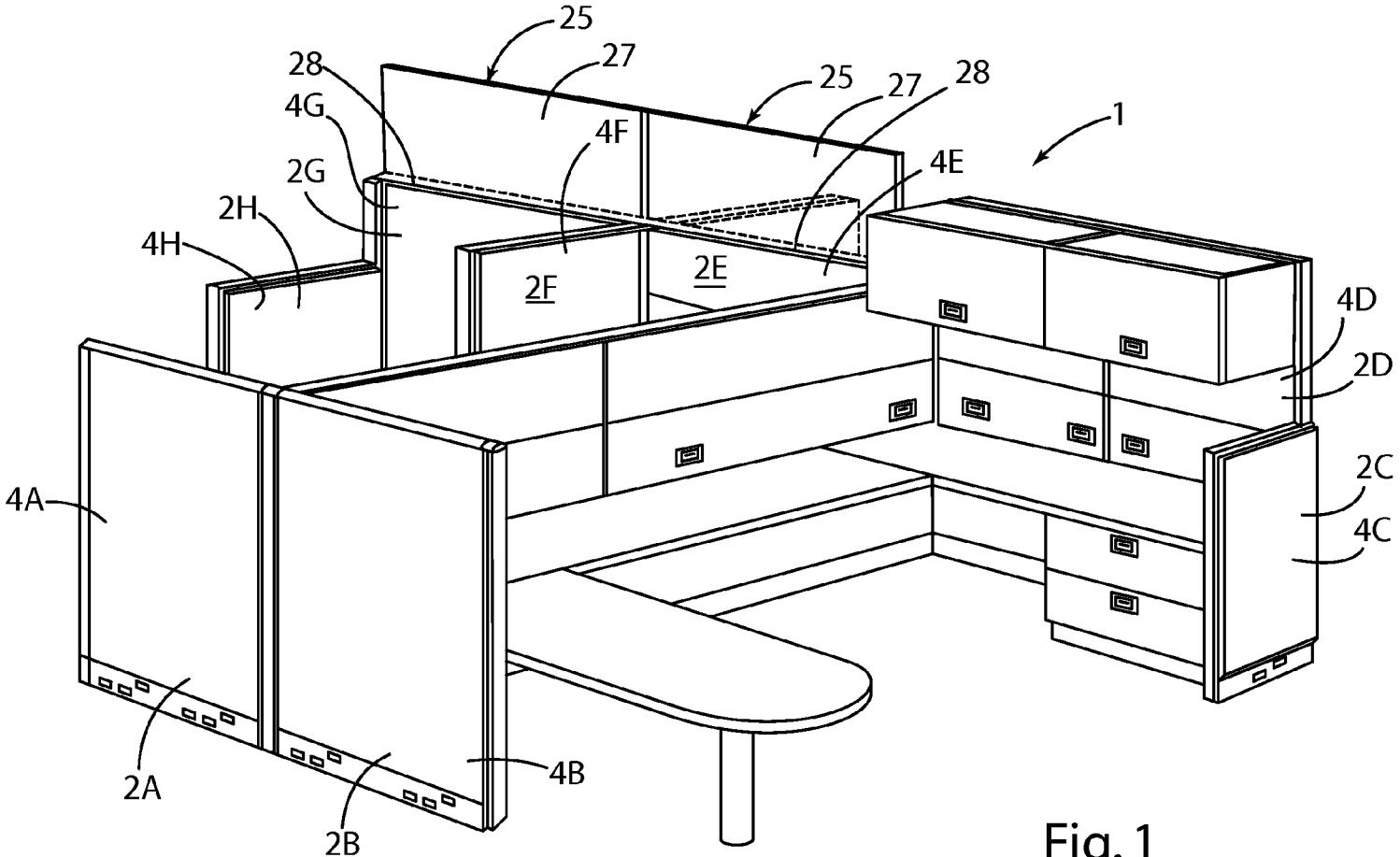
FIG. 1 is a perspective view of a partition system including a frameless glass mounting system according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a partition system 1 includes a plurality of partition panels 2A-2H that may comprise post and beam systems of the type disclosed in U.S. Pat. Nos. 6,910,306, 6,009,675, 6,079,173, 6,098,358, 6,276,103, 6,301,846, 6,442,909, 5,899,035 "Post and Beam Partition System Patents." Each partition panel 2A-2H may include a frame 10 (See frames 10A and 10B, FIG. 3) and cover panels 4A-4H. A pair of cover panels 4 are utilized in connection with each frame 10 on opposite side faces of the frames 10. Each of the individual partition panels 2A-2H may include a frame 10 having upright posts 12A-12C (see also FIG. 3) that are rigidly interconnected by upper beams 14 and lower beams 16. The upper beams 14 and lower beams 16 may have substantially the same construction, and connect to ports 18 as disclosed in more detail in U.S. Pat. Nos. 6,910,306, 6,009,675, 6,079,173, 6,098,358, 6,276,103, 6,301,846, 6,442,909, 5,899,035. In general, each beam 14, 16 includes quick connectors 20 on opposite ends thereof that provide for rigid connection to the post 12A-12C.

Figure 3:
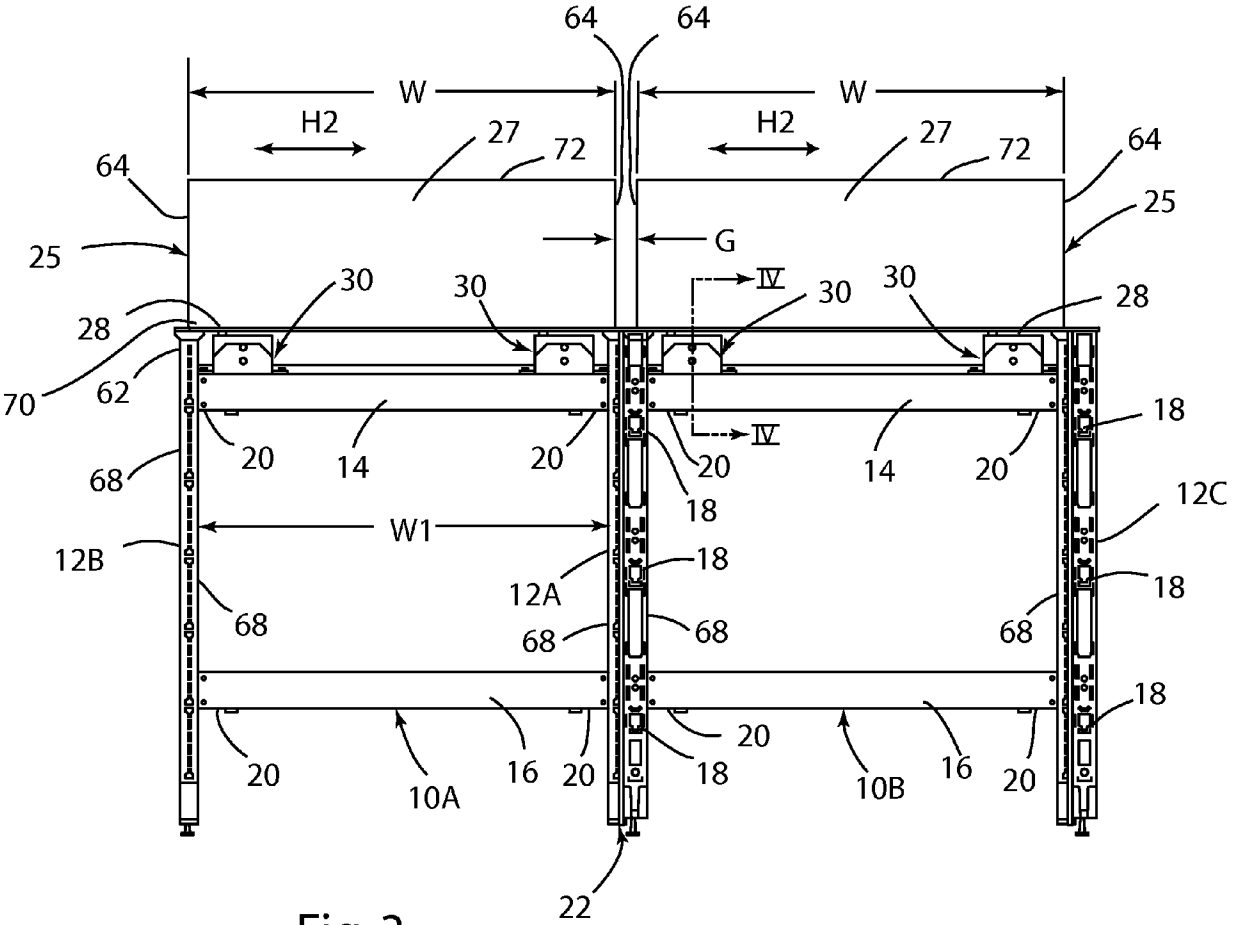
FIG. 3 is a front elevational view of a pair of side-by-side partition frames including frameless glass mounting arrangements according to another aspect of the present invention.

As shown in FIG. 3, adjacent frames 10A and 10B connect to a single upright post 12A. Thus, post 12A defines a junction that structurally interconnects adjacent partition frames 10A and 10B.

In the illustrated example, post 12B comprises a post utilized for in-line partition panel configurations, the post 12A comprises a "X" junction post, and posts 12C comprises a "T" junction post. However, the posts 12 may have a variety of configurations, examples of which are disclosed in the Post and Beam Partition System Patents.

Referring again to FIG. 1, partition system one may include frameless upper panels 25 which include sheets 27 (see also FIG. 3) that are mounted to upper edge portions 28 of partition panels 2. Sheets 27 may comprise glass or other light-transmitting material. For example, sheets 27 may comprises frosted glass, translucent colored glass, clear or transparent glass. The sheets 27 may also comprise polymer sheets that are transparent, colored, frosted, clear/transparent, or virtually any other configuration. Still further, sheets 27 may comprise sheets of wood or other material if a non light transmitting configuration is required for a particular application. Still further, various openings or other patterns (not shown) such as an array of perforations could be formed in the sheets 27 if required for a particular application.

Figure 2:
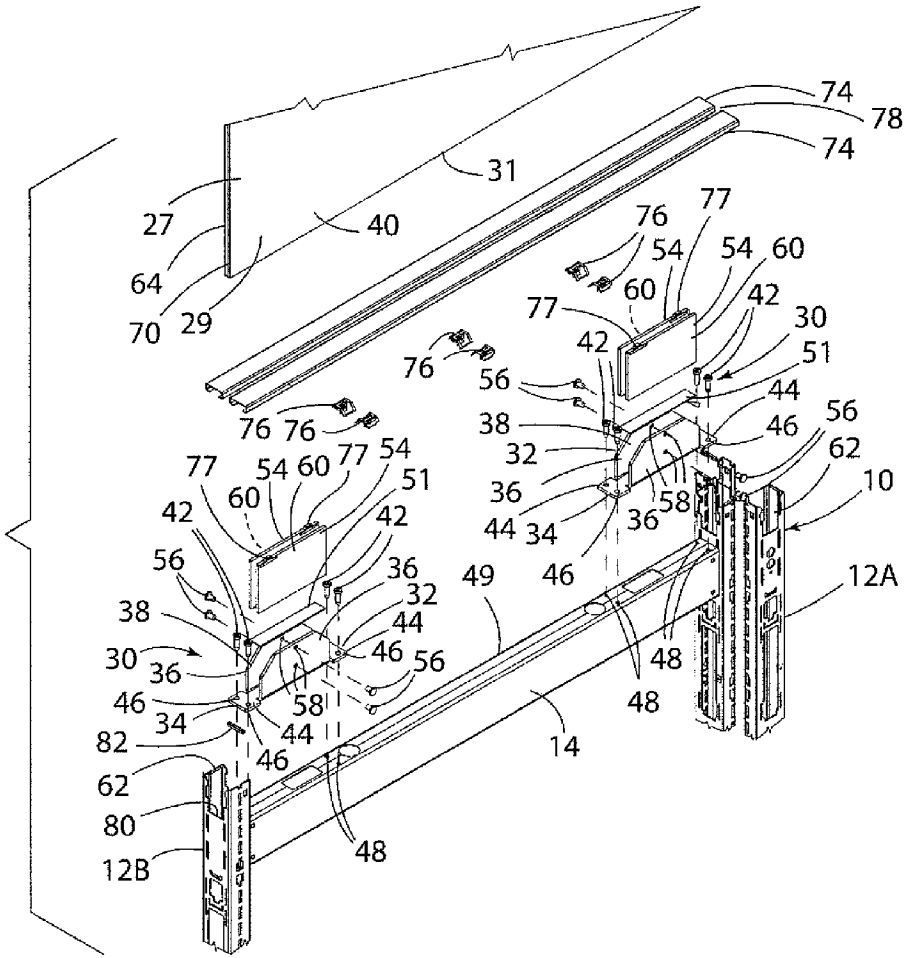
FIG. 2 is a partially fragmentary exploded isometric view of a frameless glass mounting system according to another aspect of the present invention.

With reference to FIG. 2, a lower edge portion 29 of each sheet 27 is connected to the frame 10 by a pair of bracket or support assemblies 30. Each support assembly 30 includes a bracket member 32 having a base wall or web 34 that extends horizontally, and a pair of spaced apart upwardly extending side walls or webs 36.

Figure 5:
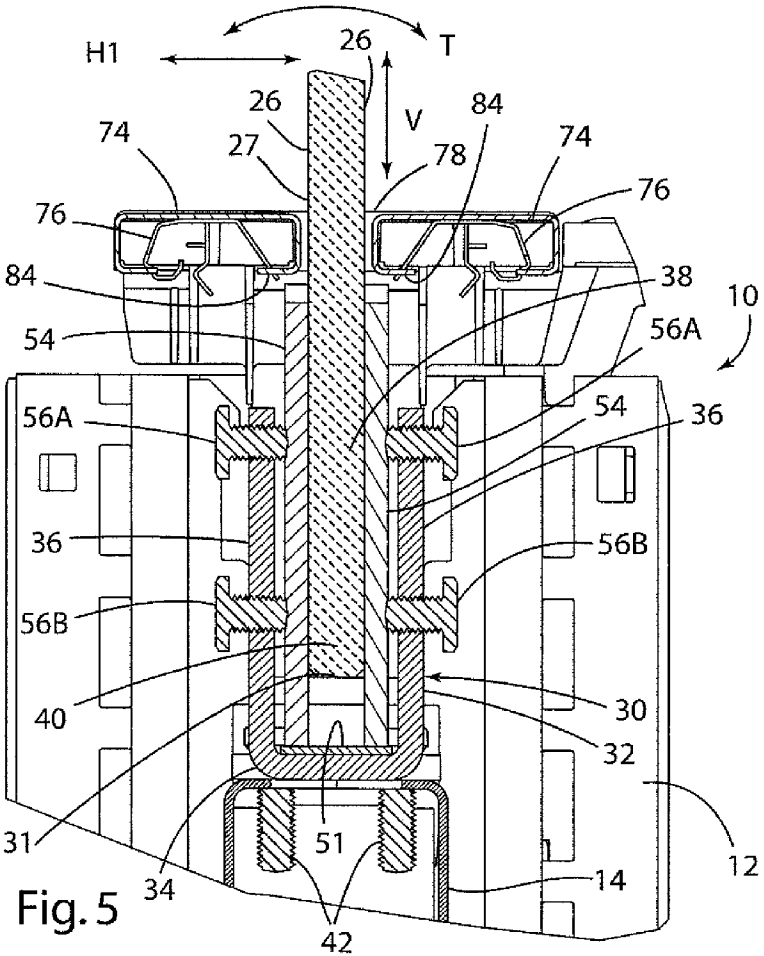
FIG. 5 is a partially fragmentary enlarged view of a portion of the frameless glass mounting system of FIG. 4.
Figure 4:
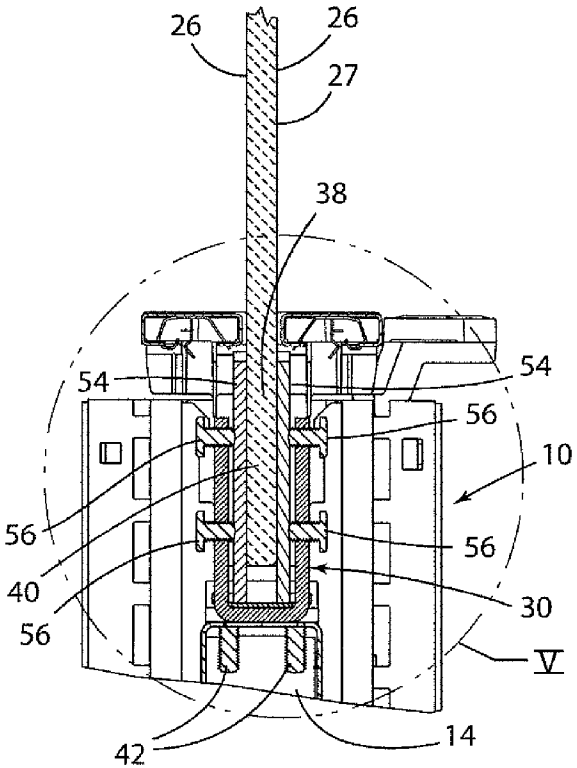
FIG. 4 is a partially fragmentary enlarged view of the system of FIG. 3 taken along the line IV-IV.

Referring to FIGS. 4 and 5, bracket member 32 has a generally U-shaped cross section forming a central channel 38 that receives a lower edge portion 40 of sheet 27. With further reference to FIG. 2, each bracket member 32 includes outwardly extending tabs 44 with openings 46 that receive threaded fasteners 42. Threaded fasteners 42 engage threaded openings 48 and upper side 49 of beam 14 to thereby rigidly secure the bracket members 32 to the beam 14. A thin rectangular strip or pad 51 is received in the central channel 38 of each bracket member 32 to cushion lower edge 31 of sheet 27. The pad or strips 51 may be made of a polymer or other material, and preferably comprise relatively low friction material that provides for sliding of lower edge 31 of sheet 27.

As described in more detail in the Post and Beam Partition System Patents, each U-shaped cutout 62 includes a horizontally extending lower edge 80. A polymer clip 82 having a downwardly-opening groove may be positioned on the edge 80 to thereby cushion the sheet 27 and prevent damage to lower edge 31 of sheet 27.

A pair of pads or clamp members 54 are received in central channels 38 of bracket members 32. Lower edge portion 29 of sheet 27 is received between clamp members 54. Threaded fasteners 56 extend through threaded openings 58 in side walls or webs 36 of bracket members 32. Threaded fasteners 56 contact outer side faces or surfaces 60 of clamp members 54 to thereby clamp the lower edge portion 29 of sheet 27.

As described in more detail in the Post and Beam Partition System Patents, posts 12 include upwardly opening U-shaped cutouts 62. Referring back to FIG. 3, sheets 27 have an overall width "W" defined between vertical edges 64 that is somewhat greater than a horizontal dimension "W1" between side faces 68 of posts 12. Thus, lower corners 70 of sheets 27 are disposed in U-shaped cutouts 62 of posts 12 when the frameless system 25 is assembled to the frame 10 of partition system 1. In this way, adjacent sheets 27 form a gap "G" (FIG. 3) between adjacent vertical edges 64. The gap "G" may be quite small whereby adjacent sheets of material 27 provide a uniform appearance.

Referring again to FIGS. 4 and 5, when assembled, the fasteners 56 are tightened to clamp the clamp members 54 against the opposite side surfaces 26 of sheet 27. The combined thickness of sheet 27 and clamp members 54 is less than a width of central channel 38 defined by bracket member 32. Thus, threaded fasteners 56 can be selectively tightened to shift the sheet 27 side-to-side in the direction indicated by the arrow "H1" (FIG. 5), or in the vertical direction "V". Still further, the sheet 27 may be tilted about the lower edge 31 by selectively tightening upper and lower threaded fasteners 56A and 56B, respectively. Still further, the sheets 27 can be shifted in a horizontal direction as indicated by the arrows "H2" (FIG. 3).

Thus, the bracket assemblies 30 permit adjustment of adjacent sheets of material 27 to align upper horizontal edges 72 of adjacent sheets 27, and also to provide for uniform gaps G between adjacent sheets 27. Still further, adjustment of the tilt angle T (FIG. 5) permits adjacent sheets 27 to be adjusted such that the side surfaces 26 of adjacent sheets 27 are substantially co planar.

When assembled, a pair of elongated trim pieces 74 are secured to the frame 10 by spring clips 76 to form an elongated opening 78 therebetween that receives lower edge portion 29 of sheet 27.

Each of the clamp members 54 may include a spring clip 77 (FIG. 2) that engages lower edge or lip 84 of each trim piece 74. The clips 77 provide for vertical adjustment of trim pieces 74 whereby trim pieces 74 of adjacent partition panels 2 can be vertically adjusted and aligned.

Sheet 27 is preferably transparent glass or polymer. However, sheet 27 may also comprise an opaque or translucent glass or polymer material. For example, the sheet 27 may comprise colored glass or polymer, or the side faces 26 of sheet 27 may be frosted or otherwise coated to provide the desired degree of light transmission and the desired appearance. Still further, sheet 27 may comprise wood or other material if required for a particular application.

The frameless mounting system 25 of the present invention permits an upright sheet of material to be installed along the upper edge of an existing partition frame 10. The bracket assemblies 30 permit the sheet of material 27 to be adjusted upwardly, sidewardly, and rotationally to thereby align adjacent sheets of material 27 to provide a uniform appearance.

Figure 6:
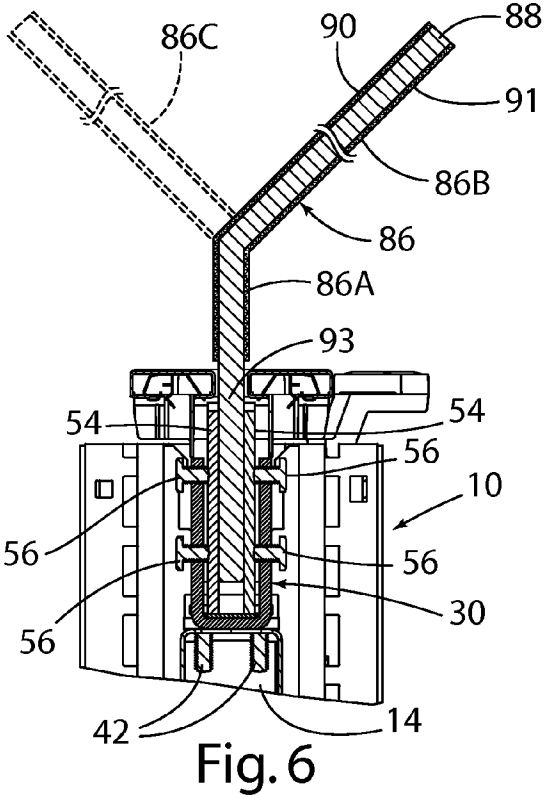
FIG. 6 is a cross sectional view of a system according to another aspect of the invention showing a canopy member.

With further reference to FIG. 6, an angled "canopy" member 86 may be supported by one or more bracket assemblies 30. The canopy member 86 includes a generally planar, upright lower portion 86A and an angled upper portion 86B. Canopy member 86 includes a frame structure 88 and outer skins or covers 90 and 91. The outer covers 90 and 91 may comprise fabric or other material that provides a pleasing appearance. Frame 88 includes a sheet-like lower portion 93 that engages the bracket assembly 30 in substantially the same manner as the lower edge portion 40 of sheets 27 as described in more detail above. The frame 88 and lower portion 93 may be made from steel or other suitable material. Canopy member 86 may have a single angled upper portion 86B, or it may have first and second angled upper portions 86B and 86C, respectively. If the canopy member 86 includes first and second upper portions 86B and 86C, the canopy member 86 is generally Y-shaped in cross section. The upper portions 86B and 86C may be configured to extend out over a work area adjacent the partition system to provide an additional degree of privacy. The position of canopy member 86 may be adjusted utilizing bracket assemblies 30 in substantially the same manner as sheets 27 as described in more detail above. The canopy member may have a width that is the same as the width "W" (FIG. 3) of sheets 27.

Figure 7:
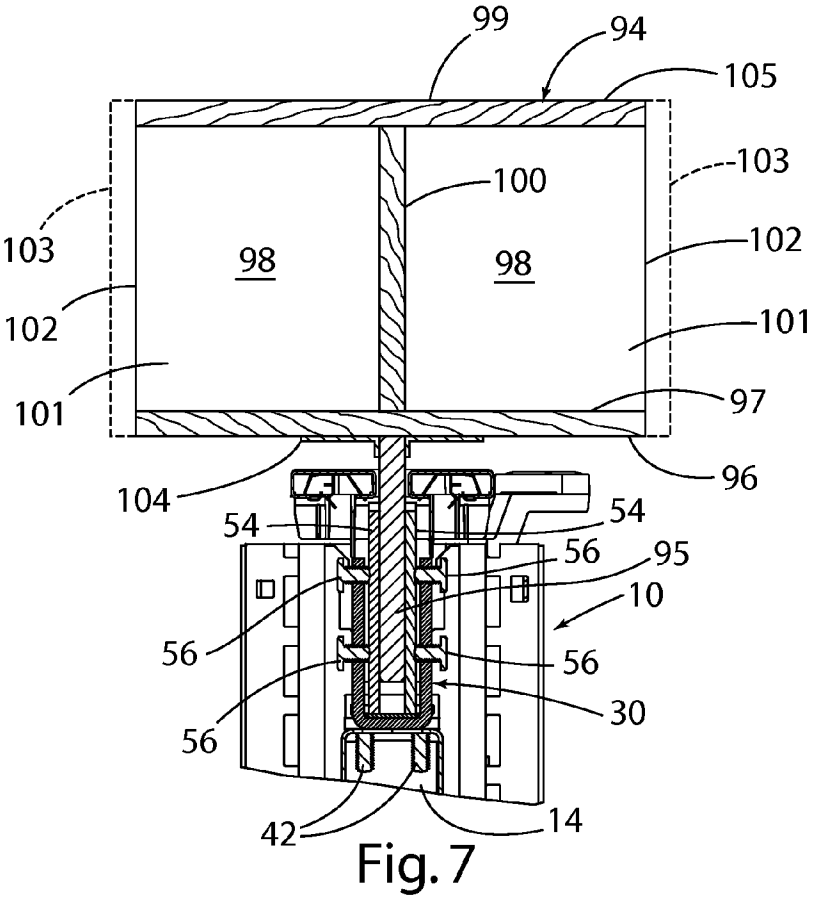
FIG. 7 is a cross sectional view of a system according to another aspect of the invention showing a storage unit.

With further reference to FIG. 7, a storage unit 94 may also be supported utilizing one or more bracket assemblies 30. The storage unit 94 includes a lower blade-like portion 95 that engages the bracket assemblies 30. The storage unit 94 includes a lower horizontal member 96 having an upwardly-facing support surface 97. Storage unit 94 optionally includes end walls 98 and upper wall 99, and vertical divider 100 that together form storage spaces 101 having side openings 102. Storage unit 94 may optionally include movable doors 103 that selectively close off openings 102. The storage unit 94 may comprise an upper structure 105 that is substantially similar to commercially available C:SCAPE storage units available from Steelcase Corporation of Grand Rapids Mich., that is attached to the lower portion 95 utilizing a bracket structure 104. The upper structure 105 may be made from wood, steel, or other suitable material. Lower portion 95 may be made from steel or other material having sufficient strength to support upper structure 105. The position of storage unit 94 may be adjusted utilizing bracket assemblies 30 in substantially the same manner as described above in connection with sheets 27.

Figure 8:
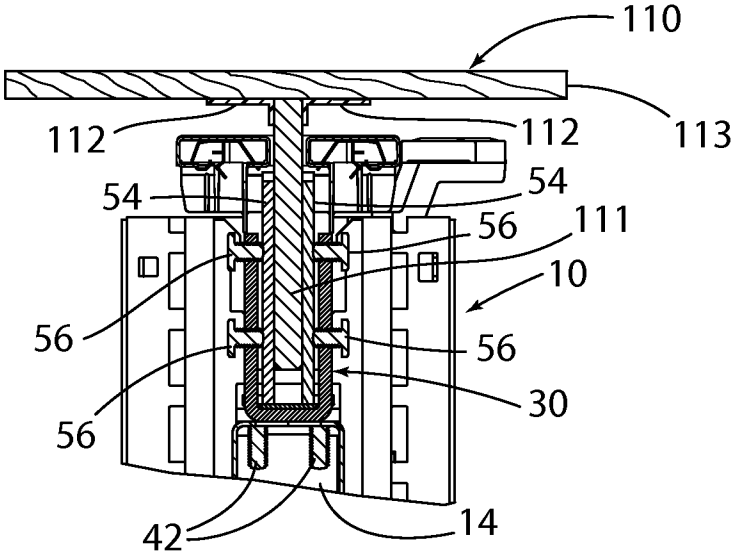
FIG. 8 is a cross sectional view of a system according to another aspect of the invention showing a transaction top.

With further reference to FIG. 8, bracket assemblies 30 may also be utilized to support a work surface such as a transaction top 110. The transaction top 110 includes a plate or blade-like support 111 that is secured to the top structure 113 by brackets 112. Top structure 113 may comprise wood or other suitable material, and support 111 and brackets 112 may be made from steel or the like. The support 111 adjustably engages the bracket assemblies 30 in substantially the same manner as described in more detail above in connection with the sheets 27.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. An extension system for adjustably supporting a sheet of material along an upper edge of a freestanding partition system, the extension system comprising:

a sheet of material, defining generally vertical opposite side faces, generally horizontal upper and lower edges, and generally vertical opposite side edges, wherein the sheet of material is configured to be positioned adjacent vertical side edges of adjacent sheets of material that are spaced apart to define gaps therebetween, each gap defining a dimension, and wherein the sheet of material defines a first horizontal position in a first direction along the lower edge, and a second horizontal direction that is transverse to the first direction;

a support assembly, the support assembly including at least two spaced apart brackets, each bracket having a horizontally extending base wall and a pair of spaced apart upwardly extending side walls to define a U-shaped cross section forming a central channel that opens upwardly along top edges of the side walls of each bracket, the central channels opening in opposite horizontal directions at opposite vertical edges of the side walls of each bracket, the horizontally extending base wall of each bracket extending horizontally outwardly in opposite directions to form tabs that project outwardly away from the opposite vertical edges of the side walls, wherein the tabs are configured to engage an upwardly facing surface of a freestanding partition system, and wherein the brackets engage the sheet of material adjacent the lower edge thereof and support the sheet of material in a generally upright position relative to the support assembly, the support assembly including movable adjustment members that permit the sheet of material to be adjustably retained at first and second selected horizontal positions relative to the base walls, a selected vertical position relative to the base walls, and a selected angular position relative to the base walls whereby the positions of the sheet of material can be adjusted relative to an upper edge of a freestanding partition system, such that the dimensions of the gaps between adjacent sheets of material are substantially the same, and whereby the sheet of material can be horizontally and vertically aligned with adjacent sheets of material.

2. The extension system of claim 1, including:

a pair of elongated trim pieces engaging the support assembly and forming an elongated opening therebetween that receives a lower edge portion of the sheet of material and wherein the elongated trim pieces extend along opposite sides of the sheet of material above the brackets.

3. The extension system of claim 2, wherein:

the movable adjustment members engage the opposite side faces of the sheets of material adjacent the lower edges thereof.

4. The extension system of claim 3, wherein:

the movable adjustment members comprise at least one pair of clamp members engaging the opposite side faces of the sheets of material.

5. The extension system of claim 4, wherein:

the support assembly includes at least one threaded member threadably engaging each bracket, the threaded members moving horizontally relative to the brackets upon rotation of the threaded members, and wherein the threaded members generate forces that clamp the clamp members against the opposite side faces of the sheets of material.

6. The extension system of claim 4, including:

spring clips disposed on the clamp members; and wherein:

the elongated trim pieces define lower edges that adjustably engage the spring clips whereby vertical positions of the elongated trim pieces can be adjusted.

7. The extension system of claim 1, wherein:

the sheets comprise light-transmitting material.

8. The extension system of claim 1, wherein:

the sheets comprise a substantially transparent material.

9. An extension system for adjustably supporting at least one sheet of material along an upper edge of a freestanding partition system, the extension system comprising:

at least one sheet of material defining opposite side faces, upper and lower edges, and opposite side edges extending between the upper and lower edges;

at least one support assembly including a base portion configured to engage a freestanding partition system, and wherein the at least one support assembly engages the at least one sheet of material adjacent the lower edge thereof and supports the sheet of material in a generally upright position relative to the support assembly, the at least one support assembly including at least first and second movable adjustment members that permit the at least one sheet of material to be shifted in opposite side-to-side directions that are transverse to the lower edge of the sheet, and wherein the at least first and second adjustment members adjustably retain the at least one sheet of material at a selected one of a plurality of horizontal side-to-side positions relative to the base portion, a selected vertical position relative to the base portion, and a selected angular position relative to the base portion, whereby the at least one support assembly is configured to permit the position of the at least one sheet of material to be adjusted relative to an upper edge of a freestanding partition system to thereby align the at least one sheet of material with adjacent sheets of material, and:

a pair of elongated trim pieces disposed above and engaging the at least one support assembly and forming an elongated opening therebetween that receives a lower edge portion of the sheet of material.

10. The extension system of claim 9, wherein:

the base portion of the at least one support assembly comprises a bracket.

11. The extension system of claim 10, wherein:

the bracket includes an upwardly-opening channel, and wherein at least a portion of the lower edge of the at least one sheet of material is received in the upwardly-opening channel.

12. The extension system of claim 11, wherein:

the at least first and second movable adjustment members engage the opposite side faces of the at least one sheet of material adjacent the lower edge thereof.

13. The extension system of claim 12, wherein:

the movable adjustment members comprise at least one pair of clamp members engaging the opposite side faces of the at least one sheet of material.

14. The extension system of claim 13, wherein:

the at least one support assembly includes at least first and second threaded members threadably engaging the bracket, the first and second threaded members moving horizontally relative to the bracket upon rotation of the treaded members, and wherein the threaded members are configured to generate forces that clamp the clamp members against the opposite side faces of the at least one sheet of material.

15. The extension system of claim of claim 13, including:

spring clips disposed on the clamp members; and wherein:

the elongated trim pieces define lower edges that adjustably engage the spring clips whereby vertical positions of the elongated trim pieces can be adjusted.

16. An extension system for adjustably supporting a sheet of material in an upright position on an upper edge of a freestanding partition system, the extension system comprising:

a sheet of material defining opposite side faces, upper and lower edges extending along a length of the sheet, and opposite side edges extending between the upper and lower edge to define a generally quadrilateral perimeter;

a support assembly configured to support the sheet of material on a partition frame in an upright position, wherein the support assembly includes a bracket having an upwardly opening channel and a pair of tabs extending outwardly in opposite directions directly below the lower edge of the sheet of material along the length of the sheet, wherein the tabs are configured to engage an upwardly facing horizontal upper surface of a partition system to thereby support the bracket on a partition system, and wherein at least a portion of the lower edge of the sheet of material is disposed in the channel, the support assembly including at least one clamp engaging the opposite side faces of the sheet of material and adjustably securing the sheet of material to the bracket such that an angular position of the sheet of material relative to the bracket can be adjusted and the angular position of the sheet of material relative to the bracket can be fixed at a selected angular position.

17. The extension system of claim 16, wherein the bracket includes first and second upwardly extending portions that are spaced apart whereby the upwardly opening channel is formed between the first and second upwardly extending portions.

18. The extension system of claim 17, wherein:

the at least one clamp includes threaded members that threadably engage at least one of the first and second upwardly extending portions of the bracket.

19. The extension system of claim 18, wherein:

the support assembly includes at least two threaded members that are vertically spaced apart such that rotation of the two threaded members causes horizontal movement of the two threaded members to thereby permit adjustment of an angular positon of the sheet of material.

20. The extension system of claim 19, wherein:

the support assembly includes a pair of vertically spaced apart threaded members threadably engaging the first upwardly extending portion of the bracket.

21. The freestanding partition system of claim 20, wherein:

the pair of vertically spaced apart threaded members comprises a first pair of threaded members; and including:

a second pair of vertically spaced apart threaded members threadably engaging the second upwardly extending portion of the bracket.

* * * * *